US006351876B1

(12) United States Patent
Uehara

(10) Patent No.: US 6,351,876 B1
(45) Date of Patent: Mar. 5, 2002

(54) SIDE RELEASE BUCKLE

(75) Inventor: Ryoichiro Uehara, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/565,702

(22) Filed: May 4, 2000

(30) Foreign Application Priority Data

May 10, 1999 (JP) ..... 11-128508

(51) Int. Cl.[7] ..... A44B 11/25
(52) U.S. Cl. ..... 24/625; 24/614; 24/615
(58) Field of Search ..... 24/614, 615, 616, 24/625

(56) References Cited

U.S. PATENT DOCUMENTS

| | | | | | |
|---|---|---|---|---|---|
| 4,825,515 | A | * | 5/1989 | Wolterstorff, Jr. | 24/625 |
| 5,440,792 | A | * | 8/1995 | Ida | 24/615 |
| 5,465,472 | A | * | 11/1995 | Matoba | 24/625 |
| 5,507,076 | A | * | 4/1996 | Anscher | 24/625 |
| 5,590,444 | A | * | 1/1997 | Krauss | 24/625 |
| 5,729,877 | A | * | 3/1998 | Kong et al. | 24/625 |
| 5,737,810 | A | | 4/1998 | Krauss | |
| 5,791,026 | A | | 8/1998 | Anscher | |
| 5,794,316 | A | * | 8/1998 | Anscher | 24/625 |
| 6,052,875 | A | * | 4/2000 | Fudaki | 24/625 |
| 6,148,486 | A | * | 11/2000 | Uchara et al. | 24/170 |

FOREIGN PATENT DOCUMENTS

| | | |
|---|---|---|
| DE | 3703 402 C1 | 6/1988 |
| EP | 0 815 761 A2 | 1/1988 |
| EP | 0 815 761 A3 | 9/1988 |

* cited by examiner

*Primary Examiner*—Anthony Knight
*Assistant Examiner*—Ruth C. Rodriguez
(74) *Attorney, Agent, or Firm*—Finnegan, Henderson, Farabow, Garrett & Dunner, L.L.P.

(57) ABSTRACT

A first hooking face and a second hooking face which are hooking end faces of an engaging portion of a plug member releasably engage a first engaging face which is a top wall end face of an opening of a socket member and a second engaging face which is a side wall end face thereof respectively, so that an engaging area increases. The side release buckle, therefore, ensures a secure and strong engagement between the plug member and the socket member and is never released easily even when an unexpected external force is applied to a side portion of the engaging portion of the plug member.

7 Claims, 7 Drawing Sheets

SIDE RELEASE BUCKLE

BACKGROUND OF THE INVENTION

1. Field of the Invention

The present invention relates to a side release buckle comprising a socket member having openings on sides thereof and a plug member having arm portions which are releasably inserted into the socket member and engageable with the openings. More specifically, the present invention relates to a side release buckle having increased engaging strength and having no risk of a fault operation in inserting the plug member into the socket member.

2. Description of the Related Art

Buckles of various structures have been well known, each of which is comprised of a female member composed of a socket member and a male member composed of a plug member, molded of synthetic resin. Speaking of its basic structure, the socket member has engaging faces, while the plug member comprises arm portions which are adapted to be releasably inserted into the socket member and engaging portions on the arm portion which engage and disengage from the engaging faces of the socket member. Each of the socket member and plug member has a base portion at its one side end thereof. A belt insertion hole is formed in each of the base portions. An end of the belt is inserted through the belt insertion hole and fixed thereto. By engaging/disengaging the socket member and/from plug member, both the belt ends can be connected to or disconnected from each other.

Among these buckles, there is a type in which openings are formed side walls of the socket member, and by fitting the engaging portions formed at front ends of the arm portions of the plug member into the openings, engaging faces of the engaging portions engage the respective parts of the openings, so that the plug member is connected to the socket member. To release this connection, side faces of the engaging portions which engage the openings so as to be exposed outside are nipped with fingers and pushed in so as to deform the arm portions resiliently. Then, the engaging portions are removed from the openings, thus the plug member is pulled out of the socket member.

A general type buckle of this kind has two arm portions extending in parallel from a base portion of the plug member, and shoulder portions are formed at front ends of arm portions so as to be projected outward from side faces of the arm portions. The arm portions are inserted into a cavity of the socket member while being resiliently deformed. When the shoulder portions reach the side face openings of the socket member, the resilient deformation of the arm portions is returned to their original state, and at the same time, the shoulder portions are inserted into the openings so that they engage portions of the opening rear end faces. Because sections of the shoulder portions cannot be formed larger than a section of the cavity, the engagement between the socket member and plug member is achieved by only engagement between the opening rear end faces formed by the right and left side walls and the shoulder portions.

Therefore, when an external force is applied to exposed surfaces of the shoulder portions while the socket member and the plug member are connected to each other, the shoulder portions are resiliently deformed so that they move easily into the cavity of the socket member. Therefore the plug member is easy to slip out of the socket member. Further, when a strong pulling force is applied to both the socket member and plug member in their connection direction, the shoulder portions and portions of the opening end faces of the side walls are damaged, so that the engaging force drops. Thus, sometimes, a sufficient function of the buckle cannot be exerted.

According to U.S. Pat. No. 5,737,810 (Japanese Patent Laid-Open Publication No. 10-117814) or U.S. Pat. No. 5,794,316, (Japanese Patent Laid-Open Publication No. 10-57114), areas of the engaging faces between the openings of the socket member and the shoulder portions of the plug member are increased so as to increase an engaging force therebetween. Particularly in the latter buckle, such an engaging structure has been proposed that distribution of the areas of the engaging faces is made uniform so as to ensure a desired strength in the engaging portions.

An engaging/disengaging structure of the buckle disclosed in the aforementioned U.S. Pat. No. 5,794,316, will be briefly described. In each of the engaging portions of the plug member, a notch portion is formed between the arm portion and the engaging portion by cutting it out. Thickness of an extended portion of the arm portion is designed to be larger than that of a projecting portion so that a step is formed between the projecting portion and the arm portion. The extended portion in the longitudinal direction of the arm portion and the portion projecting outward are constructed integrally in such a manner that a hooking face composed of lateral V-shaped or lateral U-shaped section which engages the engaging face of the socket member is formed by the step and an outer edge of the projecting portion. Each side wall portion of the cavity of the socket member is substantially the same as a contour of each lateral section of the projecting portion of the plug member. A gap between an upper wall and a bottom wall of the side wall portion is substantially the same as thickness of the extended portion of the engaging portion of the plug member.

According to the aforementioned structure of the buckle disclosed in the aforementioned U.S. Pat. No. 5,794,316, the engaging strength against a pulling increases and the strength of the engaging portion itself is improved as mentioned in the publication. However, a moving distance for the hooking face to slip out of the engaging face of the socket member is almost uniform in an entire portion of the hooking face. Further, when an unexpected external force is applied to the engaging portion of the plug member exposed outside, the projecting portion of the engaging portion is shifted horizontally into the cavity. Therefore, a process in which the engagement is released is determined only by the aforementioned moving distance irrespective of the sectional shape of the hooking face. This moving distance is necessarily limited by a structure of the buckle.

That is, even in the buckle described in the above publication, when the engaging face of the plug member slips out of the engaging face of the socket member, all the engaging faces are entirely unlatched at the same time. As a result, it never happens that even when part of the engaging face is released, the engagement of the other part is not maintained. Therefore, when an unexpected outside force is applied to the engaging portion of the plug member as described above, at the same time when the engaging portion is shifted in the aforementioned limited moving distance, the engagement is released all at once. Thus, it never happens that even when the engaging portion is shifted in such a moving distance, the engagement is still maintained. Therefore, the aforementioned buckle is not different from the conventional buckle in that the plug member easily slips out of the socket member.

SUMMARY OF THE INVENTION

Accordingly, the present invention has been achieved to solve the above problems and carry out a further improvement. An object of the invention is to provided a side release buckle in which an engaging strength between the socket member and plug member is secured, strength of engaging portions of the both members is improved, even when an unexpected external force is applied to the engaging portion of the plug member, the engaging portions are more unlikely to be released than the conventional ones and when the plug member is inserted into the socket member, the front and rear sides are not mistaken.

The above object is achieved effectively by the first to seventh aspects of the invention described below.

According to a first aspect of the invention, there is provided a side release buckle comprising a socket member and a plug member, said socket member including a top wall, a bottom wall, a pair of right and left side walls for connecting said top wall and said bottom wall with a gap therebetween and openings communicating with a cavity inside the socket member and disposed inside from said side walls, said plug member including at least one arm portion projecting from a base portion thereof and an engaging portion which engages part of said socket member at a front end of the arm portion. The arm portion of said plug member is adapted to be resiliently deformed when it is inserted into/released from said cavity of said socket member so that a hooking face of the engaging portion of said arm portion releasably engages an end face of said opening. The engaging portion is subject to a composite movement comprised of a movement perpendicular to an insertion/release direction of said arm portion and directed inward and outward of said opening and a movement toward either said top wall or bottom wall. The composite movement is generated by a composite movement generating means. Part of an end face of said opening which releasably engages hooking faces of the engaging portion of said plug member is an opening end face of the bottom wall or top wall which is opposite to a movement of said engaging portion toward the top wall or bottom wall respectively, and an opening end face of said side wall.

In the conventional buckle of this kind as well as the buckle disclosed in the above-mentioned publication, when arm portions of a plug member is inserted into a cavity of a socket member to engage the plug member from the socket member, or when an engaging portion of the plug member engaging an opening of the socket member is pressed with fingers so as to release the engagement with the socket member, a movement of the engaging portion formed at an end portion of the arm portion of the plug member caused by resilient deformation of the arm portion is all in a direction between inside and outside of the opening which is perpendicular to an extending direction of the arm portion. Thus, an engaging face composed of an end face of the opening of the socket member, which engages a hooking face of the engaging portion of the plug member, is only a side wall portion of the opening end face even when a shape of the engaging portion is modified in any way.

On the other hand, according to the present invention, the engaging movement of the engaging portion of the plug member with respect to the socket member is a composite movement comprised of a movement perpendicular to an extension of the arm portion of the plug member and in the direction between inward and outward of the opening of the socket member, and a movement directed to a top wall or bottom wall of the socket member. Therefore, the engaging face of the opening of the socket member which engages the hooking face of the engaging portion of the plug member can be both the opening end face of a bottom wall or top wall located on an opposite side to a direction of movement of the aforementioned engaging portion toward the top wall or bottom wall of the socket member, and the opening end face of the side wall.

As a result, an engaging area between the engaging portion of the plug member and engaging face of the socket member is increased largely, and an engaging strength at the time of pulling is intensified. Further, the strengths of the engaging portion of the plug member and the engaging faces of the socket member themselves can be improved. Further, at the time of engagement, the hooking face of the engaging portion of the plug member engages two opening end faces of the socket member which join in a vertical direction and substantially horizontal direction. Therefore, if an unexpected external force is applied to the engaging portion exposed out of the opening and the engagement of the opening end face is partially released, the engagement through the other opening end face is maintained temporarily. Therefore, possibility that the engagement is released by the aforementioned external force is reduced as compared to the conventional buckle.

Furthermore, since the engaging face of the opening and the hooking face of the engaging portion are engaged with each other at two faces of the upper wall side and the side wall sides, almost no steps are formed between an outer face of the top wall of the socket member and an outer face of inclined wall portions of the plug member, and between an outer face of a side wall of the socket member and an outer face of a vertical wall portion of the engaging portion of the plug member. Therefore, the buckle looks generally flat, giving a good appearance.

Further, the openings of the socket member are defined by largely cutting out the socket member toward a center of the top wall thereof. As a result, the engaging portion of the plug member to engage with each of the openings is exposed outside of the top wall of the socket member to a large extent, so that it is easy to hold the engage portion by fingers, facilitating engagement and disengagement of the buckle.

When the engaging portion of the plug member is disengaged from the opening of the socket member, the engaging portion is pushed obliquely downward. Therefore, although the engaging area between the engaging portion and the opening is large, an amount of shifts of the engaging portion, i.e. amount of deformation of the arm portion becomes much smaller so that the disengagement can be easily achieved.

The hooking face of the engaging portion may be in an arrowhead shape while the engaging face of the opening that faces the hooking face is shaped in a slope. In this case, the engaging force between the socket and plug members is increased so that the buckle can not be accidentally separated.

According to a second aspect of the invention, the composite movement generating means includes the arm portion having a twisting structure around a projecting direction thereof. Thus, when an external force is applied in one direction to the engaging portion at an end of the arm portion, components of force, for example, in a horizontal direction and vertical direction are generated by the twisting structure of the arm portion, so that the arm portion is deformed resiliently in a direction to restore the twisting while being rotated about an axis line of the arm portion. As a result, when an external force is applied in one direction to the arm portion or the external force applied is released, the engaging portion is rotated along said twisting of the arm portion and moves obliquely which is a result of composition of a movement in the horizontal direction and a movement in the vertical direction, so that the engaging portion is moved in the cavity of the socket member in the inward and outward direction.

According to a third aspect of the invention, the composite movement generating means includes the arm portion having a sectional shape to be resiliently deformed in a direction of the composite movement. That is, by forming the sectional shape of the arm portion in such a shape that the arm portion is easily deformed in a direction of a predetermined angle between the horizontal direction and vertical direction, even when an external force is applied in the horizontal direction, a component of force acts in a direction in which the arm portion is easily deformed. As a result, the arm portion is resiliently deformed in a direction of the aforementioned inclination angle.

According to a fourth aspect of the invention, at least one of the top wall and bottom wall of the socket member is symmetrical with respect to a center line along a longitudinal direction of the socket member and comprised of inclined walls which are inclined so that a height of the right and left side walls is smaller than a height of a center portion of the socket member including the center line. Thus, the cavity at a center in the width direction of the socket member is larger vertically than that at the right and left end portions. Therefore, it allows a sufficient resilient deformation of the arm portion of the plug member to the cavity. The top wall and bottom wall of the socket member may be formed symmetrically with respect to a horizontal plane.

According to a fifth aspect of the invention, one of the top wall and bottom wall of the socket member is symmetrical with respect to a center line of the socket member and comprised of inclined walls which are inclined so that a height of the right and left side walls is smaller than a height of a center portion of the socket member including the center line, and the top wall or bottom wall opposing to the inclined walls is comprised of a horizontal wall perpendicular to the side walls. Thus, because either the top wall or bottom wall of the socket member is an inclined face, the top surface or bottom surface of the socket member are not mistaken, so that no insertion error of the arm portion of the plug member occurs. Thus, the plug member can be inserted into the socket member securely. Of course, the top wall and bottom wall can be designed to be parallel to each other.

According to a seventh aspect of the invention, a thickness of the opening end face of either one of the top wall and bottom wall which the hooking faces of the engaging portion of the plug member releasably engage is larger than a thickness of the opening end face of the other one of the bottom and top walls opposing said one of the top and bottom walls. With this structure, an engaging area between the engaging portion of the plug member and the engaging face of the socket member can be increased, and further, the engaging strength and the strength against pulling can be increased. Furthermore, a wall of the socket member which is not to be engaged with the engaging portion of the plug member can be designed to be thin as much as possible if a minimum necessary strength of the socket member can be secured. This leads to reduction of material cost.

DESCRIPTION OF THE EMBODIMENTS

Figure 1:
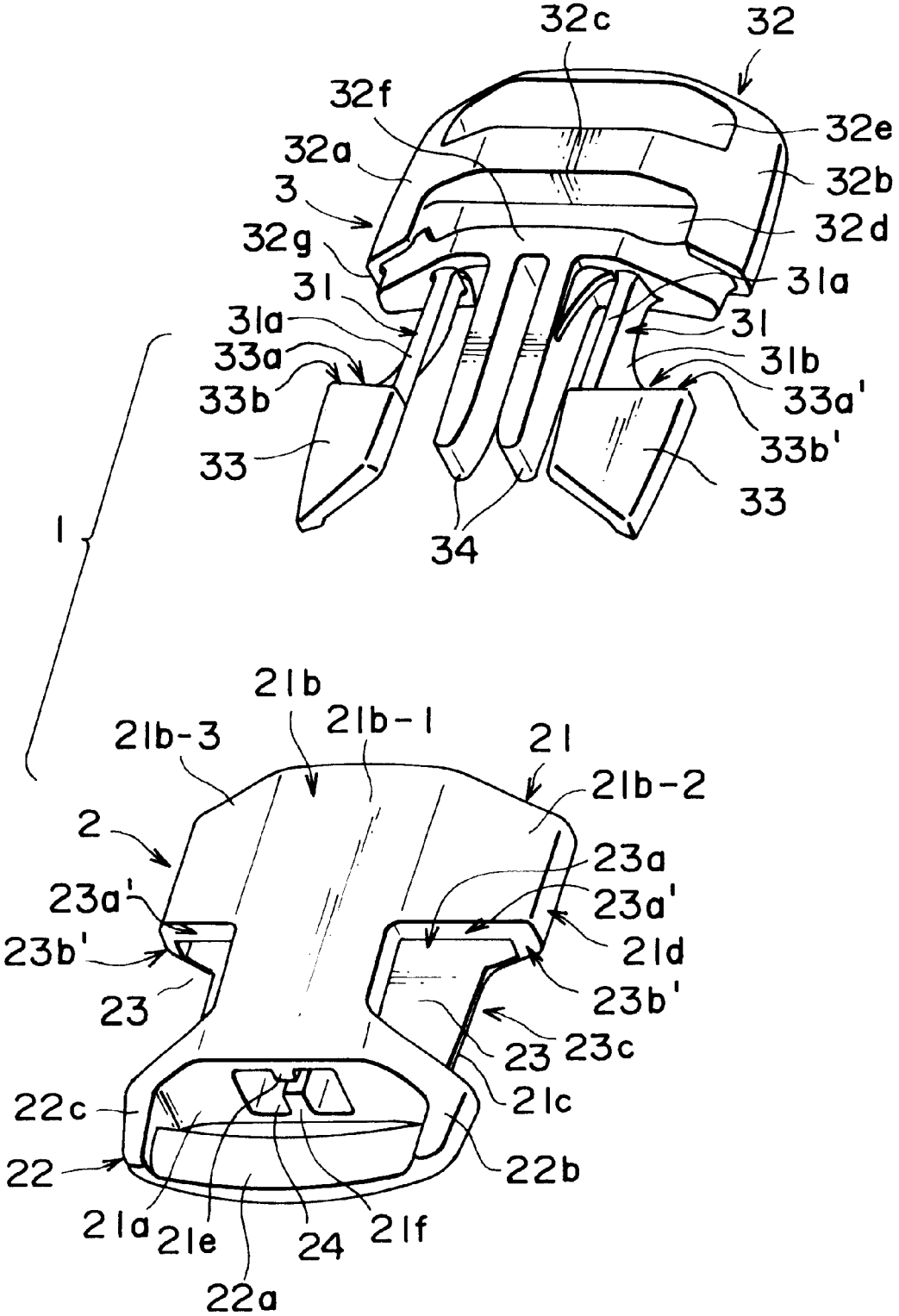
FIG. 1 is an exploded view of a buckle according to a first embodiment of the present invention as viewed obliquely from above.
Figure 2:
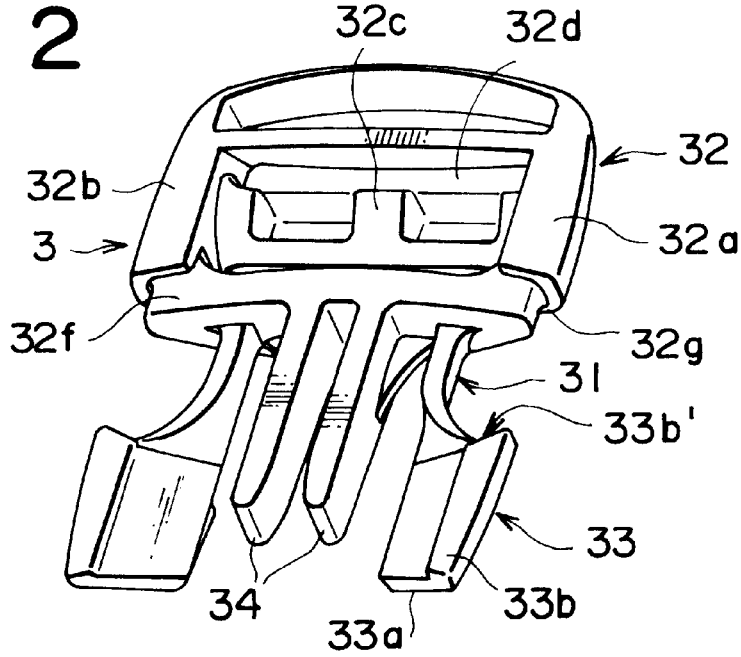
FIG. 2 is a perspective view of a rear surface of the plug member.

Hereinafter, a structure and function of a side release buckle according to embodiments of the present invention will be described in detail with reference to the accompanying drawings. Like reference numerals indicate substantially the same or equivalent members in the accompanying drawings.

FIGS. 1 to 5 show a first embodiment of the present invention. A buckle 1 of this embodiment comprises a socket member 2 which comprises a so-called female member and a plug member 3 which comprises a male member and is adapted to be releasably inserted into the socket member 2. The buckle 1 is produced by injection molding synthetic resin material. In the following description, a side of each base portion of the socket member 2 and plug member 3 is regarded as rear, and an insertion and a release side thereof is regarded as front. A front surface thereof is regarded as top, and a rear surface is regarded as bottom.

Figure 4:
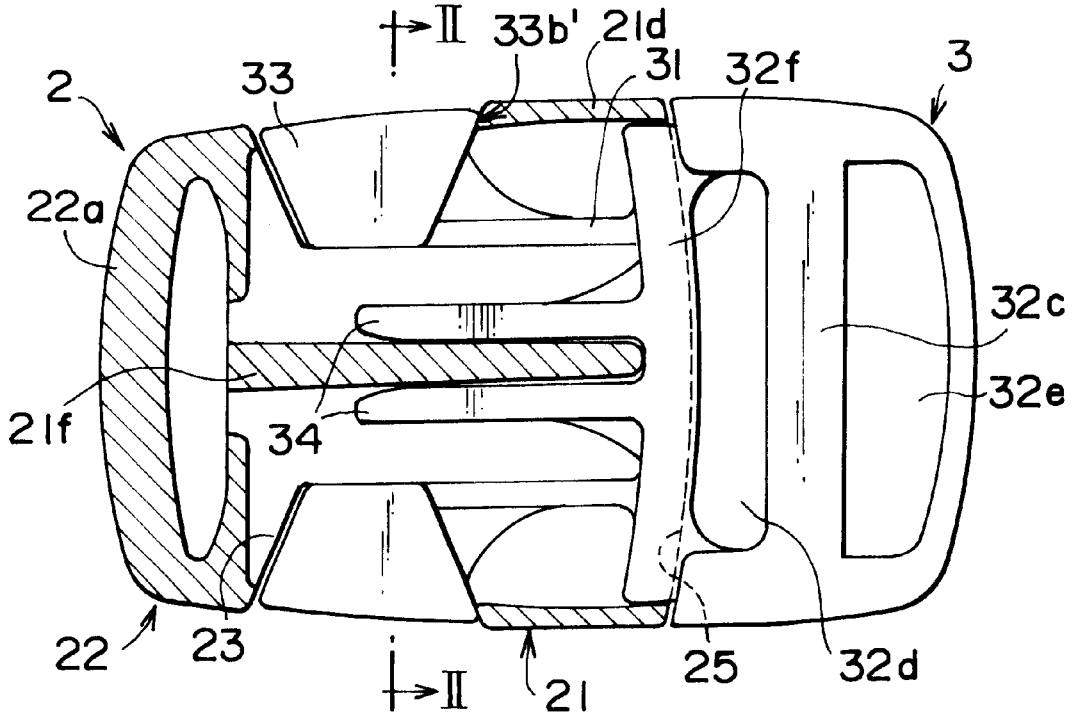
FIG. 4 is a partial sectional view showing an interior of the socket member when the buckle is engaged.
Figure 5:
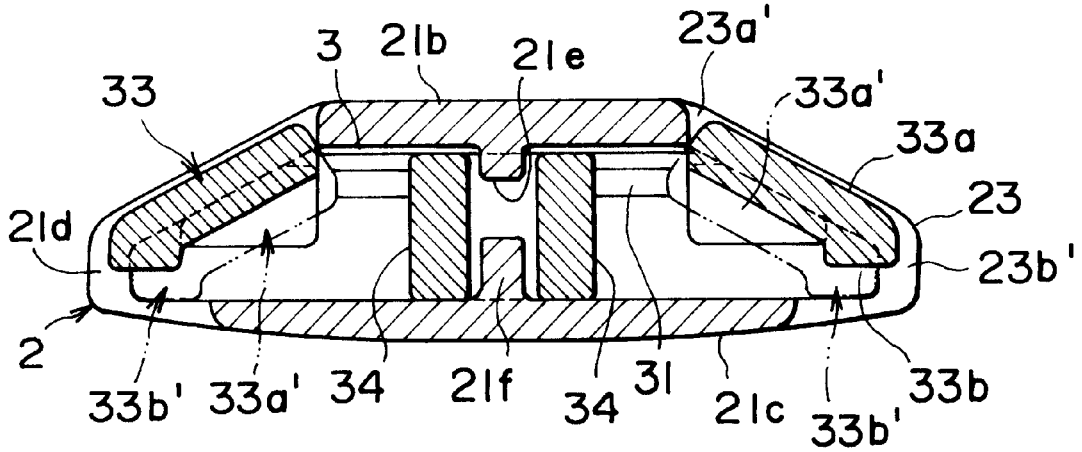
FIG. 5 is a sectional view taken along the line II—II of FIG. 4 and viewed in the arrow direction.

The socket member 2 comprises a flat box-like main body 21 having a rear wall 21*a* having a required thickness at a rear end thereof and a substantially-U shaped base portion 22 extending substantially horizontally from both ends in a width direction of the rear wall 21*a* of the main body 21. A belt (not shown) is wound around a rear end frame member 22*a* of the base portion 22 and an end thereof is fixed by sewing or the like. The main body 21, as shown in FIGS. 4 and 5, includes the rear wall 21*a*, a top wall 21*b*, a bottom wall 21*c* and side walls 21*d* for connecting right and left side edges of the top and bottom walls 21*b*, 21*c* with a predetermined gap between the top and bottom walls 21*b*, 21*c*. A pair of upper and lower guide ribs 21*e*, 21*f* extending from rear to forth in parallel are respectively provided on opposing inner walls of the top wall 21*b* and bottom wall 21*c* in such a manner that they are located in a center in a width direction of the inner walls.

According to this embodiment, the side walls 21*d* interconnect substantially half portions of the top and bottom walls 21*b*, 21*c* located on an opposite side of the base portion 22. No side walls exist in the other substantially half portions on the side of the base portion 22. The top wall 21*b* and bottom wall 21*c* are notched between the side wall 21*d* and base portion 22 to be in a substantially trapezoidal shape expanding toward outer sides thereof. Therefore, the socket member 21 of this embodiment has openings 23 produced by largely notching its right and left portions at a rear side thereof.

Further, according to this embodiment, the top wall 21*b* has a central portion in a width direction thereof, formed of a horizontal wall portion 21*b*-1 having a predetermined width extending along the rear and front direction, and at both sides thereof, inclined wall portions 21*b*-2, 21*b*-3 which are inclined downward. The bottom wall 21*c* is formed of an entire horizontal wall portion. A top face of each of the right and left frame members 22*b*, 22*c* of the base portion 22 is also formed of an inclined face in accordance with an inclined face of the socket main body 21. Then, thickness of the top wall 21*b* is designed to be larger than that of the bottom wall 21*c*, while thickness of the side wall 21*d* is designed to be larger than that of the top wall 21*b*.

The openings 23 are formed in such a manner that the notch depth of the top wall 21*b* extends up to the right and left ends of the horizontal wall portion 21*b*-1 of the top wall 21*b*. The notch depth of the bottom wall 21*c* is substantially ½ that of the top wall 21*b*. A central portion of the rear wall 21*a* is formed with a through hole 24 which extends from there rear to front with the guide ribs 21*e*, 21*f* left on a periphery thereof, and which a front end of a guide lever 34, as will be described later, of the plug member 3 is to be inserted into/released from.

On the other hand, the plug member 3 has a base portion 32 integrally formed with base ends of two arm portions 31 extending in parallel toward a front thereof. The base portion 32 has a substantially rectangular shape as viewed in plan and includes a connecting lever 32*c* for connecting right and left side frame members 32*a*, 32*b* in the center thereof in the rear to front direction. Specifically, the substantially rectangular base portion 32 has two elongated holes 32*d*, 32*e* adjacent to the connecting lever 32*c* in the front and rear thereof and vertically extending through. An end portion of a belt (not shown) is wound around the connecting lever 32*c* via these elongated holes 32*d*, 32*e* and fixed by sewing or the like, or attached without being fixed by sewing or the like.

In addition to the structure of the base portion 32 as described above, a contour of a section of the plug member 3 is designed to be the same as that of the main body 21 of the socket member 2. Further, though a sectional shape of an end frame member 32*f* on a side where the arm portions of the base portion 32 is analogous to that of the entire base portion, in order to engage into a cavity in the socket main body 21 fittingly by insertion, the end frame member 32*f* is formed smaller than the base portion by a thickness of a periphery of the socket member 21 through a step portion 32*g*.

According to this embodiment, each of the pair of the arm portions 31 has a length of difference between substantially a ½ length of the socket main body 21 in its longitudinal direction and a longitudinal length of the end frame member 32*f* of the base portion 32. An engaging portion 33 is formed integrally on the arm portion 31. The pair of the right and left arm portions 31 have symmetrical shape with respect to a center line of the base portion 32. According to the embodiment shown in FIG. 1, as understood from the Figure, a base end of each of the arm portions 31 has a substantially rectangular section. A top face 31*a* of the arm portions 31 extend linearly forward within the same plane, while the other three faces extend to be twisted outward as they go to a front end thereof so as to expand horizontally. The twisted portion is formed to be gradually thinner from its base portion to its front end so that a thin plate portion 31*b* is formed.

The thin plate portion 31*b* of the arm portion 31 is twisted largely outward as it approaches the front end thereof. Finally, the thin plate portion 31*b* at the front end becomes substantially parallel to the inclined face of the socket main body 21. As understood from FIGS. 1 and 2, the aforementioned engaging portion 33 formed integrally at the front end of each arm portion 31 is formed of a trapezoid-shaped plate member. This plate member has substantially the same plan shape as that of the plan of the opening 23 of the socket member 2, specifically a top wall opening 23*a* formed by notching the top wall 21. A horizontal sectional shape of the engaging portion 33 is a substantially horizontal L shape comprising an inclined portion 33*a* parallel to the aforementioned inclined face of the socket main body 21 and a vertical portion 33*b* disposed at an outer end of the inclined portion 33*a*. As shown in FIG. 5, the thickness of the engaging portion 33 is set to be as large as a slightly smaller thickness than the top wall 21*b* and side wall 21*d* plus the thickness of the thin plate portion at a front end of the arm portion 31.

An end face of the thin plate portion of the arm portion 31 is integrally joined to an end face of the engaging portion 33 having such a thickness and shape. That is, when the plug member 3 engages the socket member 2, a rear end face of the engaging portion 33 is connected to an end face of a front end of the thin plate member of the arm portion 31, in such a manner that an end face (first hooking face) 33*a*' of the aforementioned inclined portion 33*a* engages an inclined end face (first engaging face) 23*a*' located at a forward end of the top wall opening 23*a* of the socket member 21 while an end face (second hooking face) 33*b*' of the vertical portion 33*b* engages a side wall end face (second engaging face) 23*b*' located at a forward end of the top wall opening 23*a*.

If now, an external force is applied to each of the pair of the aforementioned engaging portions 33 in such a direction that they approach each other in a horizontal plane from outer sides thereof, a component of force perpendicular to the inclined face of the engaging portion 33 is generated by that external force and acts obliquely downward. As a result, the arm portions 31 are resiliently deformed in such a manner that the engaging portions 33 are shifted obliquely downward as mentioned above. That is, when a horizontal external force is applied in such a direction that the respective engaging portions 33 approach each other, motions of the engaging portions 33 in the horizontal direction and downward in the vertical direction thereof are automatically joined together so that the arm portions 31 are resiliently deformed obliquely downward.

When the arm portions 31 of the plug member 3 are inserted into the cavity of the socket member 2 from an insertion hole 25 thereof, the arm portions 31 advance into the cavity while resiliently deformed by inner walls of the side walls 21*d* of the socket member 2 as described above. When the engaging portions 33 reach the openings 23 of the socket member 2, forces directing obliquely downward by the side walls 21*d* are released so that the resilient deformation is released to make the engaging portions 33 revert to the original state. Consequently, the first hooking faces 33*a*' of the engaging portions 33 engage the first engaging faces 23*a*' of the socket main body 21 while the second hooking faces 33*b*' of the engaging portions 33 engage the second engaging faces 23*b*' of the socket member 21. At this time, outside side faces of the pair of the engaging portions 33 are exposed outside through the openings 23 of the socket main body 21.

A pair of guide levers 34, each of which has a vertically rectangular section, are extended and projecting from the base portion 32 between the pair of the right and left arm portions 31. The guide levers 34 sandwich the guide ribs 21*e*, 21*f* provided on upper and lower inner walls of the socket member 21 in an engaged state of the buckle. Because this pair of the guide levers 34 are inserted and guided, sandwiching the guide ribs 21*e*, 21*f* of the socket main body 21 from the right and left sides when the arm portions 31 of the plug member 3 are inserted into the cavity of the socket member 2, insertion and deformation of the arm portions 31 are carried out securely.

Particularly, according to this embodiment, because the top wall 21*b* of the socket main body 21 is comprised of a horizontal wall portion 21*b*-1 in the center, and inclined wall portions 21*b*-2, 21*b*-3 which are inclined downward to the right and left sides respectively, a sectional shape of the insertion hole 25 of the socket member 2 in which the plug member 31 is to be inserted is different between its upper part and lower part. As a result, when the arm portions 31 (engaging portions 33) of the plug member 3 are inserted, they can be inserted accurately and securely without being mistaken of the top and bottom sides thereof.

Figure 3:
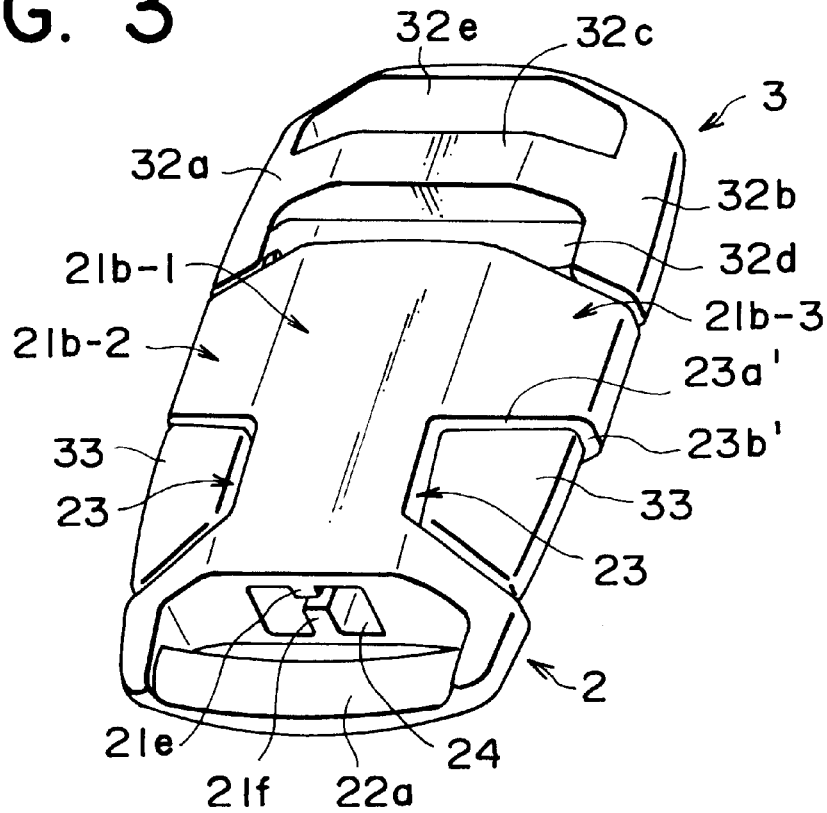
FIG. 3 is a perspective view showing an external shape when the buckle is engaged.

In the side release buckle 1 according to the first embodiment having such a structure, the paired right and left arm portions 31 are inserted into the cavity of the socket member 21 through the insertion hole 25 on an opposite side of the base portion 22 of the socket member 2 in such a manner that the paired right and left guide levers 34 of the plug member 3 sandwich the upper and lower guide ribs 21*e*, 21*f*. At the time of this insertion, horizontal forces are applied to the engaging portions 33 formed at the front ends of the arm portions 31 by the inner wall faces of the right and left side walls 21*d* of the socket member 21 in such a direction that the engaging portions 33 approach each other. As a result, the engaging portions 33 advance obliquely downward in the cavity as indicated by a phantom line of FIG. 5 while the arm portions 31 are deformed as described above. When the insertion operation is maintained in this state and the engaging portions 33 reach the right and left openings 23 of the socket main body 21, a resilient force of the arm portions 31 is released so that the arm portions 31 return to their original shapes. At the same time, the engaging portions 33 engage the openings 23 to assume a state as shown in FIG. 3 is reached.

An amount of shifts of the engaging portions 33 in the horizontal and vertical directions caused by the resilient deformation of the arm portions 31 in the cavity of the socket main body 21 is much smaller than the respective thickness of the inclined wall portions 21*b*-2, 21*b*-3 and side wall 21*d* of the socket member 21. The size of a lower wall opening 23*c* formed in the lower wall 21*c* of the socket main body 21 only needs to be set to such an extent that the vertical portions 33*b* of the engaging portions 33 do not interfere with the lower wall 21*c* of the socket member 21. Thus, the size of the lower wall opening 23*c* can be set to be much smaller than that of the upper wall opening 23*a*. Thus, even when a thickness of the lower wall 21*c* is decreased by that amount, a sufficient strength and stiffness can be secured.

In the engagement between the openings 23 and engaging portions 33, the first hooking faces 33*a*' which are end faces of the inclined portions 33*a* of the engaging portions 33 engage the first engaging faces 23*a*' which are inclined end faces located at front ends of the top wall openings 23*a* of the socket main body 21. At the same time, the second hooking faces 33*b*' which are end faces of the vertical portions 33*b* of the engaging portions 33 engage the second engaging faces 23*b*' which are side wall end faces located at the front ends of the top wall openings 23*a*.

As described above, according to this embodiment, the first engaging faces 23*a*' which are the inclined end faces of the openings 23 and the second engaging faces 23*b*' which are the side wall end faces of the socket member 2 engage the first hooking faces 33*a*' which are the inclined portions 33*a* of the engaging portions 33 and the second hooking faces 33*b*' which are the vertical portions 33*b* of the plug member 3, respectively. Thus, as compared to the conventional buckle, the engaging areas are largely increased and further, the engagement is carried out by two faces which are joined substantially at a right angle. As a result, the respective strengths of the engaging faces and hooking faces in a belt pulling direction increase.

To remove the plug member 3 from the socket member 2 in the engaged state as described above, horizontal forces are applied to the respective surfaces of the engaging portions 33 of the plug member 3 exposed on each side of the right and left openings 23 of the socket main body 21 by fingers in such a manner that the surfaces are pushed in from the both sides. As a result, the arm portions 31 of the plug member 3 are resiliently deformed to shift obliquely downward into the cavity of the socket main body 21. Consequently, when an amount of pushing of the engaging portion 33 reaches a predetermined value, the first and second hooking faces 33*a*', 33*b*' of the engaging portions 33 are removed from the first and second engaging faces 23*a*', 23*b*' of the openings 23 of the socket main body 21. Then, the engaging portions 33 can be removed from the socket main body 21 easily.

On the other hand, when an unexpected external force is applied to one engaging portion 33 for an instant, the plug member 3 does not slip out of the socket member 2 because the engaging force is sufficient as long as the engagement between the other engaging portion 33 and the corresponding opening 23 is maintained. Further, even when an unexpected external force is applied to the right and left engaging portions 33 at the same time, the first and second hooking faces 33*a*', 33*b*' do not slip out of the first and second engaging faces 23*a*', 23*b*' simultaneously except accidentally, because usually the directions of the external force are not fixed unless the engaging portions 33 are pushed in the horizontal direction intentionally. Further, the engagement can not be spontaneously released.

This is because, according to this embodiment, unless the amounts of shifts in the horizontal and vertical directions of the engaging portions 33 simultaneously exceed a size slightly smaller than the thickness of the side wall 21*d* and the inclined wall portions 21*b*-1, 21*b*-2 of the socket main body 21, the engaging portions 33 are not removed from the openings 23. Even when one of the amounts of the shifts exceeds the aforementioned size, if the other amount of the shift does not exceed it, the engagement is maintained. Further, because the unexpected external force acts for an instance in most cases, when the external force is released before the amounts of the shifts in the horizontal and vertical directions of the engaging portions 33 exceed the aforementioned size, the arm portions 31 resiliently deformed are returned to the original shapes instantaneously so that a complete engagement is regained.

Figure 6:
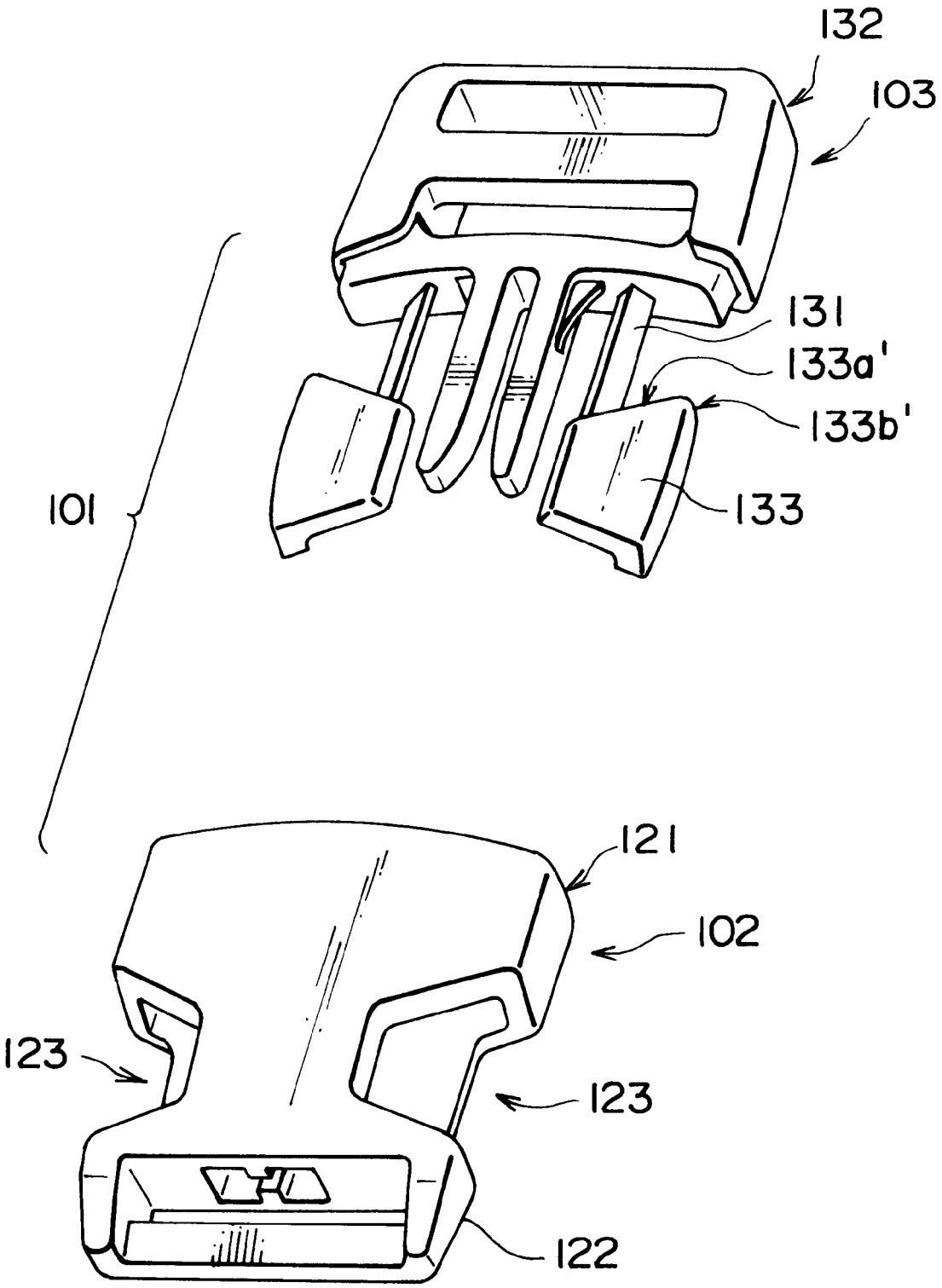
FIG. 6 is an exploded view of a buckle according to a second embodiment of the present invention as viewed obliquely from above.
Figure 7:
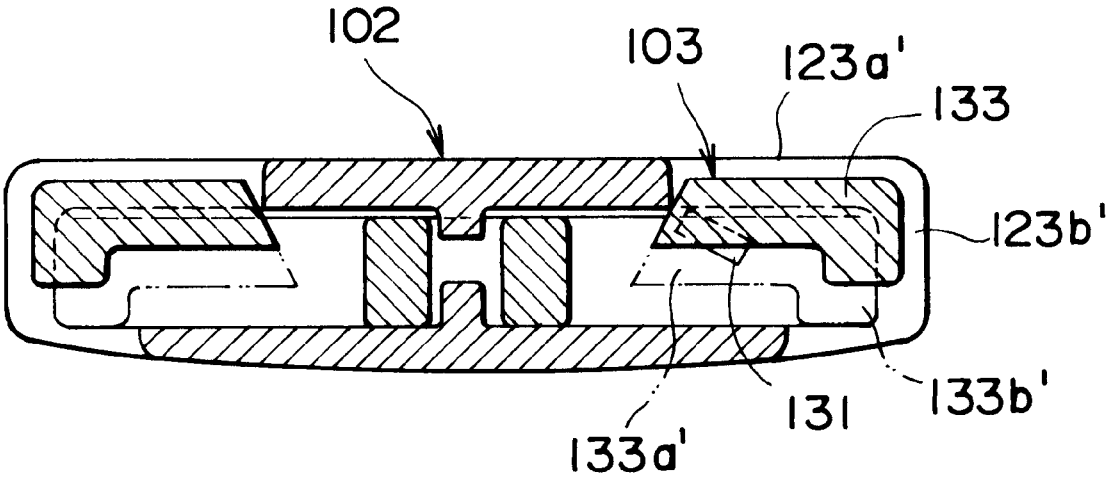
FIG. 7 is a sectional view when the buckle is engaged.

FIGS. 6 and 7 show a second embodiment of the present invention. The second embodiment is different from the first embodiment in that an entire shape of a main body 121 of the socket member 2 is box-like shape having entirely a flat rectangular section; each of arm portions 131 of a plug member 103 is generally extended linearly with respect to a base portion 132; and a shape of each arm portion 131 is entirely plate, which is inclined downward at a predetermined angle from inside of the base portion 132 toward outside.

Each of first hooking faces 133*a*' of engaging portions 133 connected to front ends of the arm portions 131 assumes a horizontally elongated rectangular section based on a shape of the socket main body 121 and a shape of the arm portion 131 of the plug member 103, while each of the second hooking faces 133*b*' assumes a vertically elongated rectangular section. Each of the first hooking faces 133*a*' and each of the second hooking faces 133*b*' are perpendicularly jointed to each other.

Now when an external force directing inward is applied to an external surface of the engaging portions 133, the arm portions 131 are resiliently deformed inward and downward so that the engaging portions 133 are automatically shifted inward and downward. Thus, in engaging operation of the buckle 101, only by inserting the engaging portions 133 of the plug member 103 into an insertion hole of the socket main body 121, the arm portions 131 are resiliently deformed inward and downward, and, likewise the first embodiment, the engaging portions 133 engage the openings 123 of the socket main body 121 so that the plug and socket members 2, 3 engage each other. In releasing operation of the buckle 101, only by applying a horizontal force to inwardly push each engaging portion 133 of the plug member 103 which is exposed from the right and left openings 123, the arm portions 131 are resiliently deformed inward and downward likewise the first embodiment. Then, the engaging portions 133 are released from the openings 123 of the socket main body 121 likewise the first embodiment, so that connection of the both members 2, 3 is released easily.

Figure 8:
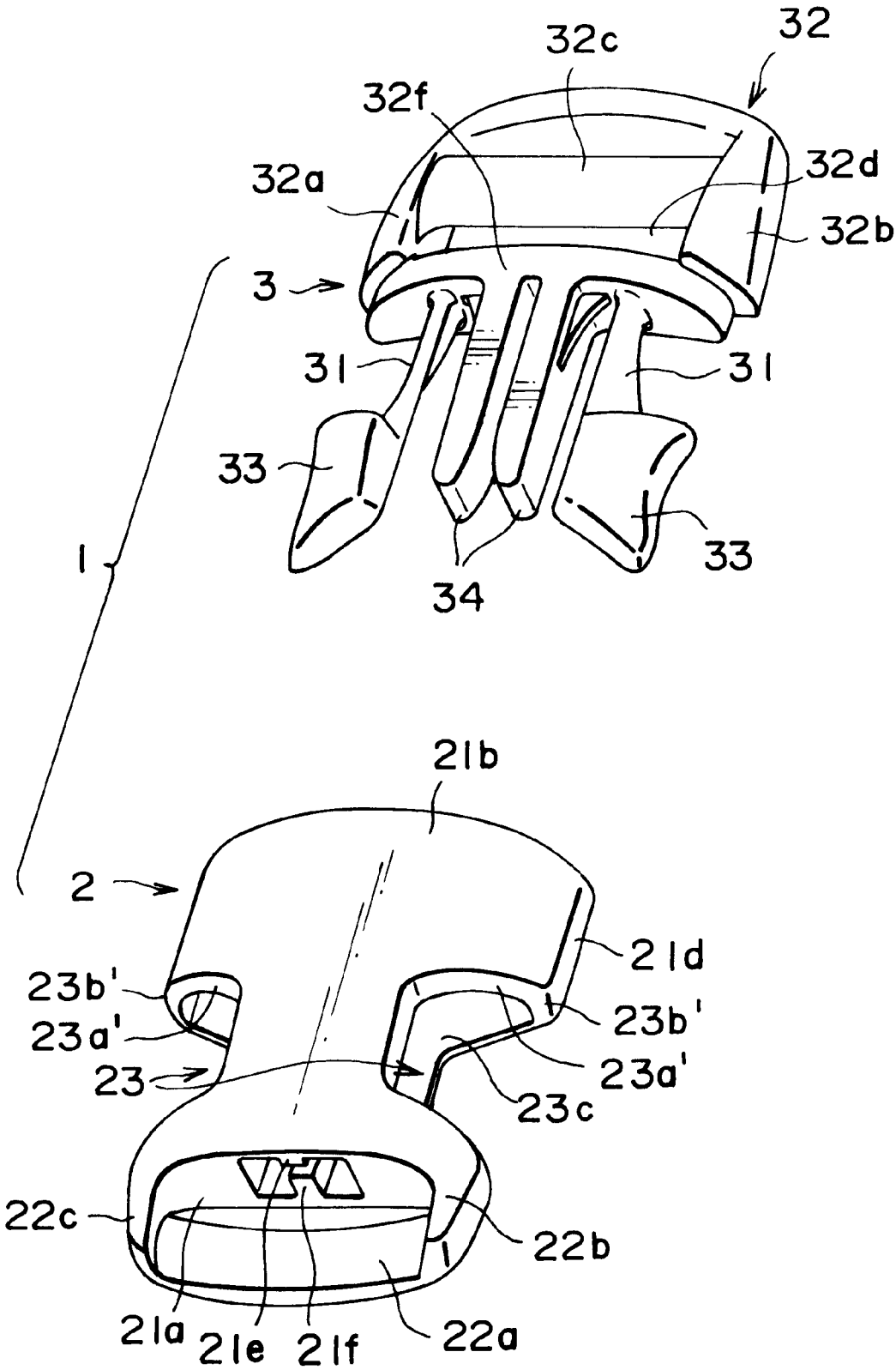
FIG. 8 is an exploded view of a buckle according to a third embodiment of the present invention as viewed obliquely from above.
Figure 9:
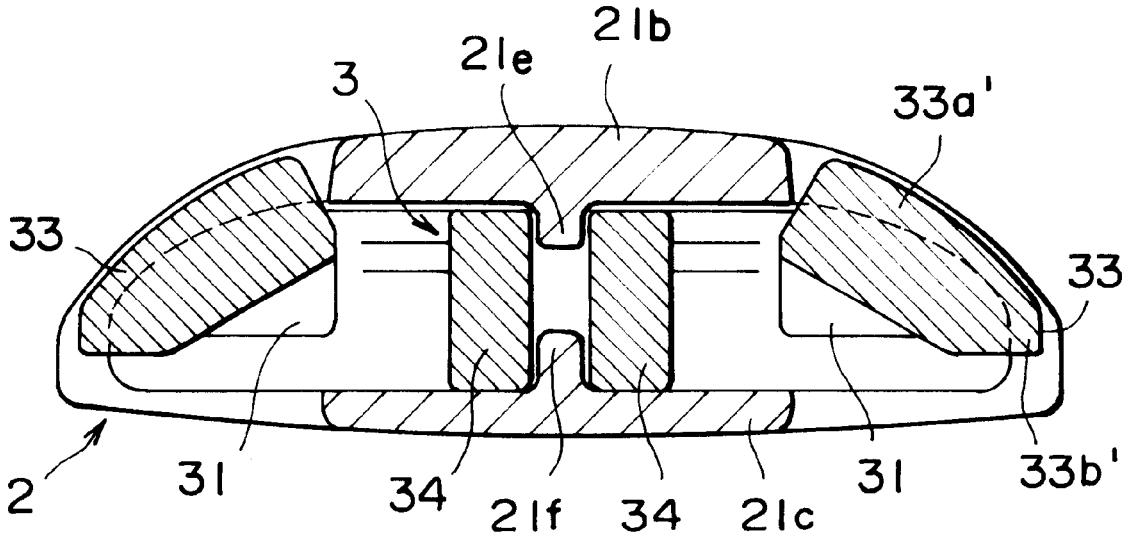
FIG. 9 is a sectional view when the buckle is engaged.

FIGS. 8 and 9 show a third embodiment of the present invention. This embodiment is different from the first embodiment in that an external shape of each of a socket member 2 and a plug member 3 is of arc shape descending toward right and left side walls 21*d* from a center of a top wall 21*b*, while according to the first embodiment, the external shape of each of the socket member 2 and plug member 3 is constituted of the horizontal wall portion 21*b*-1 which is a center of the top wall 21*b*, and the inclined wall portions 21*b*-2, 21*b*-3 which are inclined toward the side walls 21*d*, extending from the right and left of the horizontal wall portion 21*b*-1. The other structures are substantially the same as the first embodiment. Therefore, a concrete description thereof is omitted.

As understood from the above description, the present invention should not be restricted to the above described embodiments. For example, the external shape of the socket member 2, sectional shape of the cavity, shapes of the openings 23, shapes of the arm portions 31, engaging portions 33 of the plug member 3 and the like may be modified in various ways within a scope as recited in the following claims. In the above-mentioned embodiment, the right and left walls 21*d* stand perpendicularly to the bottom wall 21*c* in a front view of the buckle 1. Alternatively, for example, the bottom wall may be comprised of a horizontal wall portion and inclined wall portions likewise the top wall so that the socket member 2 generally assumes an octagonal shape.

What is claimed is:

1. A side release buckle comprising a socket member and a plug member, said socket member having a top wall, a bottom wall, a pair of right and left side walls for connecting said top wall and said bottom wall with a gap therebetween and openings communicating with a cavity inside the socket member and disposed inside from said side walls, said plug member including at least one arm portion projecting from a base portion thereof and an engaging portion which engages part of said socket member at a front end of the arm portion, said arm portion of said plug member being adapted to be resiliently deformed when it is inserted into/released from said cavity of said socket member so that a hooking face of the engaging portion of said arm portion releasably engages an end face of each of said opening, wherein said engaging portion is subject to a composite movement comprised of a movement perpendicular to an insertion/release direction of said arm portion and directed inward and outward of said opening and a movement toward either said top wall or bottom wall, said composite movement being generated by a composite movement generating means, and part of an end face of each of said opening which releasably engages hooking faces of the engaging portion of said plug member is an opening end face of the bottom wall or top wall which is opposite to a movement of said engaging portion toward the top wall or bottom wall respectively, and an opening end face of said side walls.

2. A side release buckle according to claim 1, wherein said composite movement generating means includes the arm portion having a twisting structure around a projecting direction thereof.

3. A side release buckle according to claim 1, wherein said composite movement generating means includes the arm portion having a sectional shape to be resiliently deformed in the direction of the composite movement.

4. A side release buckle according to claim 1, wherein at least one of the top wall and bottom wall of the socket member is symmetrical with respect to a center line along a longitudinal direction of the socket member and comprised of inclined walls which are inclined so that a height of the right and left side walls is smaller than a height of a center portion of the socket member including said center line.

5. A side release buckle according to claim 1, wherein one of the top wall and bottom wall of the socket member is symmetrical with respect to a center line of the socket member and comprised of inclined walls which are inclined so that a height of the right and left side walls is smaller than a height of a center portion of the socket member comprising said center line, and the top wall or bottom wall opposing to said inclined walls is comprised of a horizontal wall perpendicular to the side walls.

6. A side release buckle according to claim 1, wherein said top wall is parallel to said bottom wall.

7. A side release buckle according to claim 1, wherein a thickness of the opening end face of either one of the top wall and bottom wall which the hooking faces of the engaging portion of the plug member releasably engage is larger than a thickness of the opening end face of the other one of the bottom and top walls opposing to said one of the top and bottom walls.

* * * * *